United States Patent [19]

Bouchard et al.

[11] Patent Number: 5,066,892

[45] Date of Patent: Nov. 19, 1991

[54] GLOW DISCHARGE LAMP WITH INCANDESCENT FILAMENT

[75] Inventors: Andre C. Bouchard, Peabody; Radomir Lagushenko; Jakob Maya, both of Brookline, all of Mass.

[73] Assignee: GTE Products Corporation, Danvers, Mass.

[21] Appl. No.: 678,571

[22] Filed: Dec. 7, 1990

[51] Int. Cl.[5] ..... H05B 41/00

[52] U.S. Cl. ..... 315/46; 315/47; 315/62; 315/66; 315/73; 313/9; 313/595; 313/619

[58] Field of Search ..... 315/46, 47, 49, 56, 315/58, 62, 64, 66, 68, 73, 74; 313/8, 9, 595, 601, 619, 316

[56] References Cited

U.S. PATENT DOCUMENTS

| | | | |
|---|---|---|---|
| 1,925,648 | 9/1933 | Spanner | 176/122 |
| 2,560,933 | 7/1951 | Chun et al. | 313/346 |
| 3,215,881 | 11/1965 | Waymouth | 313/109 |
| 3,521,122 | 7/1970 | Peek, Jr. | 315/99 |
| 3,849,699 | 11/1974 | Roche | 315/46 |
| 3,878,416 | 4/1975 | Roche et al. | 313/3 |
| 4,268,780 | 5/1981 | Roche et al. | 315/179 |
| 4,278,916 | 7/1981 | Regan et al. | 315/64 X |
| 4,329,622 | 5/1982 | Corona et al. | 315/49 |
| 4,939,417 | 7/1990 | Biblarz et al. | 315/8 X |

*Primary Examiner*—Robert J. Pascal
*Attorney, Agent, or Firm*—Carlo S. Bessone

[57] ABSTRACT

A glow discharge lamp includes a sealed lamp envelope containing a noble gas and mercury, a cathode and an anode disposed in the lamp envelope and an incandescent filament for emitting visible light for illumination immediately upon application of power and for emitting little or no visible light after a glow discharge is formed between the cathode and the anode. The filament, the cathode and the anode are electrically connected in series. The lamp envelope typically includes a phosphor coating for emission of visible light upon absorption of ultraviolet radiation from the glow discharge. An optional switch can be used for disconnecting the filament during steady state operation of the glow discharge lamp.

16 Claims, 3 Drawing Sheets

GLOW DISCHARGE LAMP WITH INCANDESCENT FILAMENT

FIELD OF THE INVENTION

This invention relates to glow discharge lamps and, more particularly, to glow discharge lamps having an incandescent filament for providing visible light during starting. The incandescent filament is extinguished during steady state operation of the glow discharge lamp.

BACKGROUND OF THE INVENTION

A glow discharge lamp includes a light transmitting lamp envelope containing a noble gas and mercury. The lamp envelope typically has the shape of a conventional incandescent lamp with a bulbous portion and a neck portion. A phosphor coating is applied to the inner surface of the lamp envelope. One or more cathodes and one or more anodes are mounted within the lamp envelope. Upon heating of the electrodes and application of a voltage between the electrodes, a glow discharge is formed within the lamp envelope. The phosphor coating absorbs ultraviolet radiation that is emitted by the glow discharge and emits visible light. Examples of glow discharge lamps are disclosed in U.S. Pat. No. 3,814,971 issued June 4, 1974 to Bhattacharya, U.S. Pat. No. 2,067,129 issued Jan. 5, 1937 to Marden, U.S. Pat. No. 4,408,141 issued Oct. 4, 1983 to Byszewski et al and U.S. Pat. No. 4,751,435 issued June 14, 1988 to Roche et al.

One disadvantage of a glow discharge lamp used for general purpose illumination is that when power is applied to the lamp, the lamp does not provide illumination instantaneously. Starting for typical glow discharge lamps can take from three to ten seconds. A bimetal switch or other thermally-sensitive switch is connected in series between the anode and cathode. When the power switch is closed, the electrodes and an emissive coating on the electrodes are heated, thereby causing emission of electrons. A gas breakdown occurs, and ultraviolet radiation is emitted by the glow discharge. After a glow discharge is established, the bimetal switch opens. In a standard fluorescent lamp, this sequence of events occurs in less than one second. However, in a glow discharge lamp used for general purpose illumination, starting takes considerably longer because more massive, low electrical resistance electrodes are used to supply relatively high discharge currents. It is known that smaller, higher resistance electrodes will start the glow discharge lamp more rapidly. However, this configuration is undesirable because the smaller electrodes overheat during steady state operation. Furthermore, the smaller electrodes do not hold sufficient emissive material to insure a long lamp life.

Various approaches have been proposed for overcoming the slow starting of glow discharge lamps. One technique involves the application of a short duration, high current pulse through the cathode, thereby causing rapid heating. This technique requires a relatively complicated starting device. Another technique, disclosed in U.S. Pat. No. 3,215,881 issued Nov. 2, 1965 to Waymouth, involves the use of a small electrode for starting and a large electrode for steady state operation. This technique also complicates the lamp construction.

A fluorescent lamp having incandescent filaments connected in parallel with each electrode is disclosed in U.S. Pat. No. 3,521,122, issued July 21, 1970 to Peek, Jr. Since the incandescent filaments emit light during steady state operation, the efficiency of the lamp is reduced. Peek, Jr. states that the incandescent filaments can be switched out of the circuit during normal operation of the lamp.

A germicidal lamp wherein two electrodes coated with an emissive material are connected in series is disclosed in U.S. Pat. No. 2,560,933 issued July 17, 1951 to Chun et al. Although current flows through the electrodes during starting, the current is insufficient to cause emission of significant visible light from the electrodes.

U.S. Pat. No. 3,849,699, issued Nov. 19, 1974 to Roche, discloses a self-igniting, fluorescent lamp including an ignition coil which extends between the ends of the lamp and is coated with an electron emissive material. The ignition coil does not emit significant visible light.

U.S. Pat. No. 3,878,416, issued Apr. 15, 1975 to Roche et al, discloses a fluorescent lamp having an ignition coil which extends between the ends of the lamp and a separate incandescent lamp outside the fluorescent lamp envelope which acts as a ballast for the fluorescent lamp. The ignition coil does not emit significant visible light. The incandescent lamp is illuminated during steady state operation and thereby reduces the operating efficiency of the assembly. A lamp assembly including a fluorescent lamp and a separate incandescent lamp which acts as a ballast for the fluorescent lamp is also disclosed in U.S. Pat. No. 4,268,780, issued May 19, 1981 to Roche et al. Since the incandescent lamp is on during steady state operation, the efficiency of the assembly is relatively low.

U.S. Pat. No. 1,925,648, issued Sept. 5, 1933 to Spanner et al, discloses a gas discharge device having an elongated envelope with electrodes mounted at each end and a helix which extends between the ends of the lamp envelope. The helix is coated with an electron emissive material and does not emit substantial visible light.

U.S. Pat. No. 4,329,622, issued May 11, 1982 to Corona et al, discloses a low pressure gas discharge lamp containing a pair of high power, low emissivity filaments and a pair of high emissivity filaments. The low emissivity filaments provide additional light to compensate for the reduced illumination profile near the ends of the lamp. Since the filaments remain on during steady state operation, the efficiency of the lamp is reduced by the filaments.

All of the known arrangements for starting glow discharge lamps or other fluorescent lamps have one or more disadvantages, including increased cost and complexity, failure to provide visible light immediately when power is applied to the lamp and reduced efficiency during steady state operation. It is desirable to provide a glow discharge lamp which overcomes these disadvantages.

It is a general object of the present invention to provide improved glow discharge lamps.

It is another object of the present invention to provide glow discharge lamps which emit visible light immediately upon application of power.

It is a further object of the present invention to provide glow discharge lamps which have high operating efficiencies.

It is yet another object of the present invention to provide glow discharge lamps which are simple in construction and low in cost.

SUMMARY OF THE INVENTION

According to the present invention, these and other objects and advantages are achieved in a glow discharge lamp comprising a sealed lamp envelope enclosing a noble gas and mercury, cathode electrode means including a cathode disposed in the lamp envelope, anode electrode means including an anode disposed in the lamp envelope, and light-emitting means for emitting visible light for illumination substantially immediately upon application of power to the glow discharge lamp and for emitting little or no visible light for illumination after a glow discharge is formed between the cathode electrode means and the anode electrode means. The light-emitting means is electrically connected such that the cathode, the light-emitting means and the anode are electrically connected in series. The lamp envelope typically includes a phosphor coating on its inner surface for emission of visible light upon absorption of ultraviolet radiation from the glow discharge.

The light-emitting means preferably comprises an incandescent filament electrically connected between the cathode electrode means and the anode electrode means. The cathode electrode means can include one or more cathodes and lead-in wires connected to opposite ends of each cathode. The anode electrode means can include one or more anodes and lead-in wires connected to opposite ends of each anode. The incandescent filament is preferably connected between a cathode lead-in wire and an anode lead-in wire such that the cathode, anode and filament are electrically in series. The filament can be located in a base region of the lamp envelope so that heat from the filament warms the mercury fill material. Alternatively, the filament can be located in proximity to the cathode and the anode to cause heating thereof. The filament can include a first section located adjacent to the cathode and a second section located adjacent to the anode.

The filament is preferably located within the lamp envelope, but can also be located outside the lamp envelope. When the filament is located outside the lamp envelope, it is mounted within a separate lamp envelope. An optional switching means can be utilized for electrically disconnecting the filament during steady state operation of the glow discharge lamp. In a preferred embodiment, the switching means comprises a bimetal switching device connected in series with the filament.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
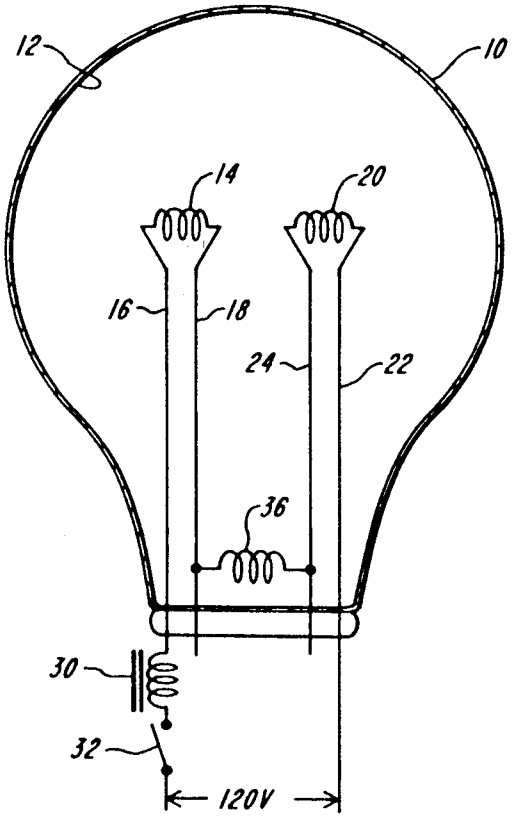
FIG. 1 is a cross-sectional view of a glow discharge lamp in accordance with the present invention.

A glow discharge lamp in accordance with the present invention is shown in FIG. 1. A sealed, light-transmissive lamp envelope 10 has a phosphor coating 12 on its inner surface. The phosphor coating 12 emits visible light upon absorption of ultraviolet radiation. Suitable phosphor compositions are well known in the art. The lamp envelope 10 contains a fill material including a noble gas, such as neon, and mercury. A cathode 14 is supported within the lamp envelope 10 by lead-in wires 16 and 18 connected to opposite ends of cathode 14. An anode 20 is supported within lamp envelope 10 by lead-in wires 22 and 24 connected to opposite ends of anode 20. The cathode 14 and the anode 2 typically comprise tungsten coils having an electron emissive coating. The lamp can include one or more cathodes and one or more anodes. The lead-in wires 16, 18, 22 and 24 are typically molybdenum. A choke ballast 30 and a power switch 32 are connected in series with one of the lead-in wires. The lamp is energized by 120 volt AC power applied between the cathode 14 and the anode 20. In the embodiment of FIG. 1, AC power is connected between cathode lead-in wire 16 and anode lead-in wire 22.

According to the present invention, an incandescent filament 36 is electrically connected in series with cathode 14 and anode 20. Preferably, the incandescent filament 36 is connected between cathode lead-in wire 18 and anode lead-in wire 24 such that cathode 14, filament 36 and anode 20 are electrically connected in series. The filament 36 can be connected to lead-in wires 18 and 24 by a process of welding.

When power switch 32 is closed, current flows through cathode 14, incandescent filament 36 and anode 20. The incandescent filament 36 provides sufficient visible light for illumination instantaneously after the switch 32 is closed. As used herein, "instantaneously" refers to the visual perception of the user. The cathode 14 and the anode 20 gradually warm and emit electrons. After a few seconds, a discharge forms between cathode 14 and anode 20, and ultraviolet radiation emitted by the discharge stimulates emission of visible light from the phosphor coating 12. The discharge between cathode 14 and anode 20 has a lower resistance than incandescent filament 36. Since the discharge is electrically in parallel with the filament 36, the current through incandescent filament 36 is reduced. When the current through the filament 36 is reduced, light emission from filament 36 is substantially reduced or eliminated entirely.

The characteristics of the incandescent filament 36 are selected such that the filament 36 emits visible light for illumination immediately upon application of power. However, the resistance of the filament 36 is selected such that the filament 36 is extinguished and no longer emits significant visible light after a discharge is established between cathode 14 and anode 20. During steady state operation, only a small current flows through filament 36, and most of the lamp current flows through the discharge between cathode 14 and anode 20. As a result, the efficiency of the glow discharge lamp is relatively high during steady state operation. Typically, cathode 14 and anode 20 have an electrical resistance in the range of about 0.2 ohm to 0.8 ohm, and filament 36 has an electrical resistance in the range of about 1.0 ohm to 20 ohms. Preferably, the ratio between the resistance of filament 36 and the resistance of cathode 14 and anode 20 is the range of about 2:1 to 20:1.

In the embodiment of FIG. 1, the incandescent filament 36 is located in a base or neck region of lamp envelope 10. With this arrangement, the heat from the filament 36 during starting warms the mercury fill material which normally collects in the base region, thereby causing the mercury to vaporize relatively rapidly and promoting rapid formation of a glow discharge.

Figure 2:
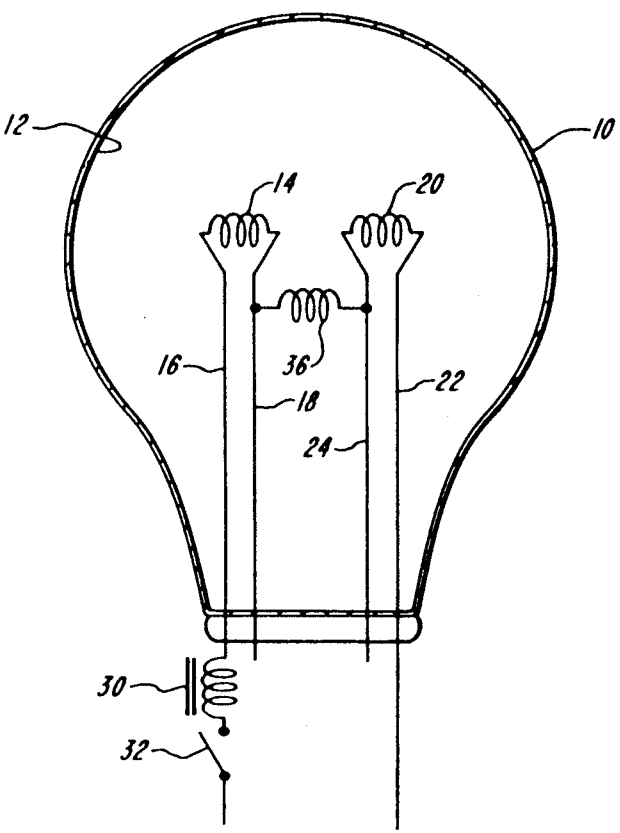
FIG. 2 is a cross-sectional view of a preferred embodiment of a glow discharge lamp in accordance with the invention, showing placement of the incandescent filament near the electrodes.

A preferred embodiment of the invention is shown in FIG. 2. The glow discharge lamp shown in FIG. 2 is the same as the lamp shown in FIG. 1 and described above, except that incandescent filament 36 is located in close proximity to cathode 14 and anode 20. The advantage of the configuration shown in FIG. 2 is that heat from filament 36 causes rapid heating of cathode 14 and anode 20, thereby promoting rapid formation of a glow discharge between cathode 14 and anode 20. Thermal energy is radiated directly from incandescent filament 36 to cathode 14 and anode 20. Although the configuration of FIGS. 1 and 2 may reduce the time required for formation of a glow discharge, the primary function of the incandescent filament 36 is to provide visible light during starting.

Figure 3B:
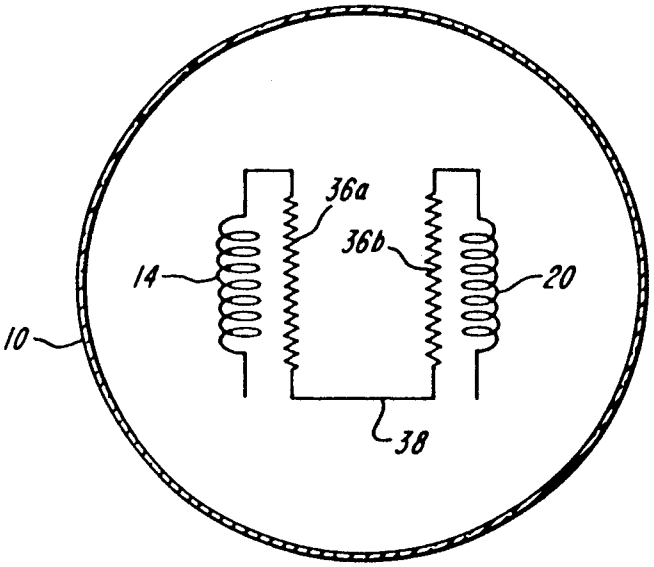
FIGS. 3A and 3B are top views of the glow discharge lamp showing placement of the incandescent filament near the electrodes.
Figure 3A:
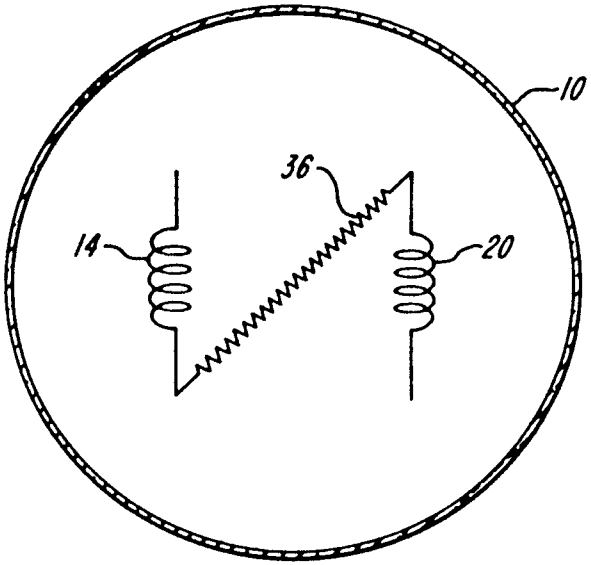

Top views of glow discharge lamps with filament 36 located in close proximity to cathode 14 and anode 20 are shown in FIGS. 3A and 3B. In FIG. 3A, the incandescent filament 36 is located in close proximity to cathode 14 and anode 20 and is oriented diagonally between one end of cathode 14 and the other end of anode 20. In this configuration, the filament 36 is relatively close to both cathode 14 and anode 20 and promotes rapid heating thereof. In FIG. 3B, the filament 36 includes a first section 36*a*, which is generally parallel to and in close proximity to cathode 14, and a second section 36*b*, which is generally parallel to and in close proximity to anode 20. The sections 36*a* and 36*b* are connected in series by a conductor 38. The configuration of FIG. 3B provides the advantage of even more rapid heating of cathode 14 and anode 20, since the filament portions 36*a* and 36*b* are located in close proximity to the respective electrodes.

Figure 4:
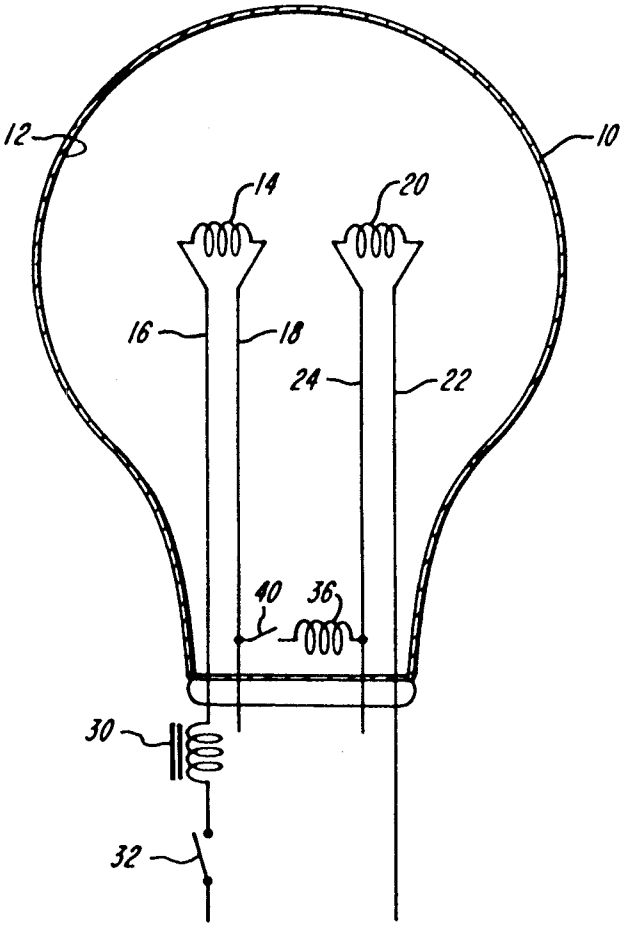
FIG. 4 is a cross-sectional view of a glow discharge lamp having a bimetal switch connected in series with the incandescent filament.

Yet another embodiment of the invention is illustrated in FIG. 4. The glow discharge lamp in FIG. 4 is the same as the lamp shown in FIG. 1 and described hereinabove, except that a switching device 40 is connected in series with the incandescent filament 36. The switching device 40 is closed during starting of the glow discharge lamp so that the incandescent filament 36 provides instantaneous visible light upon application of power. Switching device 40 opens after a glow discharge is formed in the lamp and the lamp reaches steady state operation. The purpose of the switching device 40 is to eliminate the small current which flows through the incandescent filament during steady state operation. As a result, the efficiency of the glow discharge lamp in accordance with the invention is increased. The switching device 40 can be a bimetal switch, a glow bottle or other thermally-sensitive switching device.

Figure 5:
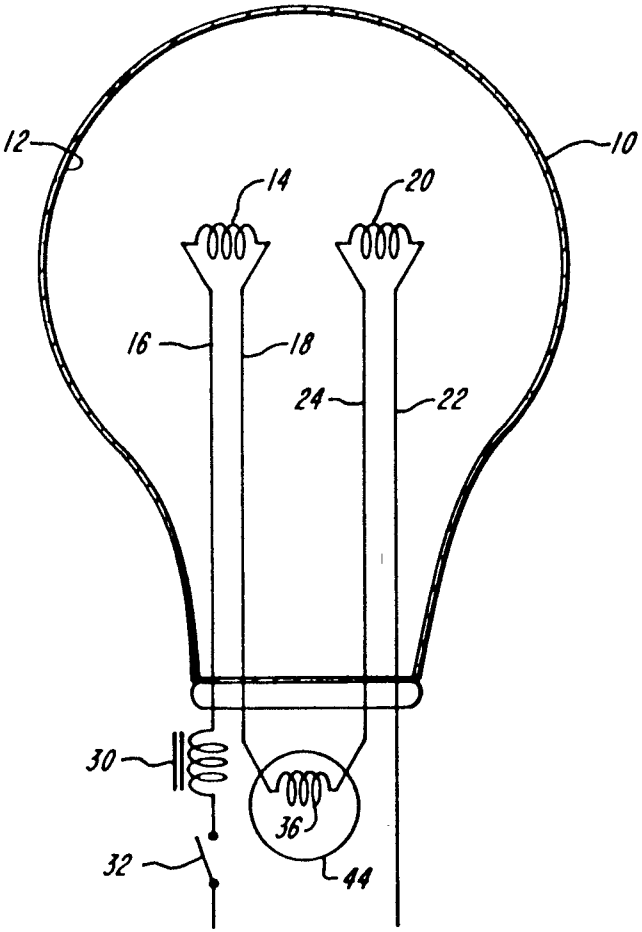
FIG. 5 is a cross-sectional view of a glow discharge lamp having an external incandescent filament.

Yet another embodiment of the glow discharge lamp in accordance with the invention is shown in FIG. 5. The lamp of FIG. 5 is the same as the lamp of FIG. 1, except that the incandescent filament 36 is located outside the lamp envelope 10. Since the filament 36 is outside the lamp envelope 10, it is enclosed within a lamp envelope 44 which provides the appropriate inert atmosphere for operation of filament 36. The lamp shown in FIG. 5 operates in the manner described above in connection with FIG. 1.

In a first example of a glow discharge in accordance with the invention, the electrodes 14 and 20 each had a resistance of 0.6 ohm, and filament 36 had a resistance of 2.2 ohms. The lamp envelope 10 was a standard A-23 incandescent jacket. The fill gas was 99.5% neon and 0.5% argon at a fill pressure of 1.5 torr. The lamp included approximately 15 milligrams of mercury. An incandescent filament was located near the base of the lamp envelope and electrically connected as shown in FIG. 1. The lamp of the first example provided approximately 650 lumens instantaneously upon application of power.

In a second example, a 100 watt incandescent filament having a resistance of 8 ohms was mounted in a glow discharge lamp as shown in FIG. 2. The lamp construction was otherwise the same as the lamp of the first example described above. Due to the higher resistance filament, a lower percentage of the lamp current flows through the incandescent filament 36 during steady state operation. The lamp constructed in accordance with the second example provided the following test results: lamp current=2.0 amps, lamp voltage=16.0 volts, lamp power=31.3 watts, lumen output=790 lumens, lumens per watt=25.2. The lumens per watt efficiency compares with an efficiency of about 28-30 lumens per watt for prior art glow discharge lamps not having an incandescent filament. The reduction in efficiency is a result of current flow through the incandescent filament 36 during steady state operation. As discussed above, the steady state current through filament 36 can be eliminated with a switching device 40. The lamps constructed in the first and second examples are capable of being cycled repeatedly, with the incandescent filament 36 providing sufficient visible light for illumination instantaneously upon application of power.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A glow discharge lamp comprising:

a sealed lamp envelope enclosing a noble gas and mercury;

cathode electrode means including a cathode disposed in said lamp envelope;

anode electrode means including an anode disposed in said lamp envelope; and light-emitting means for emitting visible light for illumination substantially instantaneously upon application of power to the glow discharge lamp and for emitting little or no visible light for illumination after a glow discharge is formed between said cathode electrode means and said anode electrode means, said light-emitting means being electrically connected such that said cathode, said light-emitting means and said anode are electrically connected in series.

2. A glow discharge lamp as defined in claim 1 wherein said light-emitting means comprises an incandescent filament.

3. A glow discharge lamp as defined in claim 2 further including a phosphor coating on an inner surface of said lamp envelope.

4. A glow discharge lamp as defined in claim 3 wherein said lamp envelope includes a base region and wherein said filament is located in the base region.

5. A glow discharge lamp as defined in claim 3 wherein said filament is located in proximity to said electrode means so as to cause heating of said electrode means.

6. A glow discharge lamp as defined in claim 3 wherein said filament includes a first section located adjacent to said cathode electrode means and a second section located adjacent to said anode electrode means.

7. A glow discharge lamp as defined in claim 3 wherein said filament is located within said lamp envelope.

8. A glow discharge lamp as defined in claim 3 wherein said filament is located external to said lamp envelope.

9. A glow discharge lamp as defined in claim 3 further including switching means for electrically disconnecting said filament during steady state operation of said glow discharge lamp.

10. A glow discharge lamp as defined in claim 9 wherein said switching means comprises a bimetal switching device connected in series with said filament.

11. A glow discharge lamp comprising:

a sealed lamp envelope enclosing a noble gas and mercury, said lamp envelope having a phosphor coating on an inner surface thereof;

a cathode mounted in said lamp envelope;

an anode mounted in said lamp envelope;

means for coupling electrical energy to said cathode and said anode; and an incandescent filament located within said lamp envelope and electrically connected in series with said cathode and said anode, the characteristics of said incandescent filament being selected to emit visible light for illumination substantially instantaneously upon application of power to the glow discharge lamp and to emit little or no visible light for illumination after a glow discharge is established between said cathode and said anode.

12. A glow discharge lamp as defined in claim 11 wherein said means for coupling comprises cathode lead-in wires connected to said cathode and anode lead-in wires connected to said anode and wherein said filament is connected between one of said cathode lead-in wires and one of said anode lead-in wires.

13. A glow discharge lamp as defined in claim 12 wherein said filament is located adjacent to a base region of said lamp envelope.

14. A glow discharge lamp as defined in claim 12 wherein said filament is located in proximity to said anode and said cathode so as to cause heating thereof.

15. A glow discharge lamp as defined in claim 12 wherein said filament includes a first section located adjacent to said cathode and a second section located adjacent to said anode.

16. A glow discharge lamp as defined in claim 12 further including switching means for electrically disconnecting said filament during steady state operation of said glow discharge lamp.

* * * * *